US006820453B2

(12) United States Patent
Takahashi et al.

(10) Patent No.: US 6,820,453 B2
(45) Date of Patent: Nov. 23, 2004

(54) METHOD OF ROLLING SHEET AND ROLLING MACHINE

(75) Inventors: Masanori Takahashi, Kobe (JP); Akio Adachi, Akashi (JP); Shinji Takaoka, Kobe (JP); Ichiro Chikushi, Kawanishi (JP); Ryuro Kurahashi, Amagasaki (JP)

(73) Assignees: Kawasaki Jukogyo Kabushiki Kaisha, Kobe (JP); Nakayama Steel Works, Ltd., Osaka (JP)

( * ) Notice: Subject to any disclaimer, the term of this patent is extended or adjusted under 35 U.S.C. 154(b) by 46 days.

(21) Appl. No.: 10/239,791

(22) PCT Filed: Mar. 29, 2001

(86) PCT No.: PCT/JP01/02688

§ 371 (c)(1),
(2), (4) Date: Sep. 25, 2002

(87) PCT Pub. No.: WO01/72442

PCT Pub. Date: Oct. 4, 2001

(65) Prior Publication Data

US 2003/0101787 A1 Jun. 5, 2003

(30) Foreign Application Priority Data

Mar. 29, 2000 (JP) ..... 2000-091388

(51) Int. Cl.[7] ..... B21B 13/14
(52) U.S. Cl. ..... 72/241.2
(58) Field of Search ..... 72/241.2, 241.4, 72/241.6, 241.8, 77

(56) References Cited

U.S. PATENT DOCUMENTS 2,118,284 A * 5/1938 Worthington ..... 72/243.2
3,124,020 A * 3/1964 Polakowski ..... 72/11.4
3,997,370 A * 12/1976 Horvath et al. ..... 72/365.2
4,724,698 A * 2/1988 Ginzburg ..... 72/243.4
6,240,756 B1 * 6/2001 Tsugeno ..... 72/8.1

FOREIGN PATENT DOCUMENTS

| | | | | |
|---|---|---|---|---|
| JP | 51-47421 | | 12/1976 | |
| JP | 57019103 | A * | 2/1982 | ..... B21B/1/22 |
| JP | 61165210 | A * | 7/1986 | ..... B21B/13/14 |
| JP | 61262405 | A * | 11/1986 | ..... B21B/1/22 |
| JP | A 1-218706 | | 8/1989 | |
| JP | A 2-299708 | | 12/1990 | |
| JP | 11123406 | A * | 5/1999 | ..... B21B/13/14 |
| JP | A 11-123418 | | 5/1999 | |

* cited by examiner

*Primary Examiner*—Lowell A. Larson

(57) ABSTRACT

A sheet rolling method uses a rolling mill (10) for rolling a sheet (x). The rolling mill (10) includes upper and lower backup rolls (13, 14), and a pair of work rolls (11, 12) respectively having different diameters and disposed between the upper and the lower backup roll (13, 14). A small-diameter work roll (11) of the pair of work rolls is disposed so that a rotational axis thereof is positioned on a mill center or a downstream side with respect to the mill center in a rolling direction, and the large-diameter work roll (12) is disposed so that a rotational axis thereof is positioned on a downstream side with respect to the rotational axis of the small-diameter work roll (11) in the rolling direction. Thus, mechanical load on the work rolls (11, 12) can be reduced even when a high rolling force is necessary for rolling a wide sheet.

5 Claims, 4 Drawing Sheets

METHOD OF ROLLING SHEET AND ROLLING MACHINE

BACKGROUND OF THE INVENTION

1. Field of Invention

The present invention relates to a rolling mill provided with a pair of work rolls having different diameters, and a sheet rolling method employing the same rolling mill.

2. Description of Related Art

A conventional rolling mill is provided with upper and lower work rolls respectively having different diameters and supported by upper and lower backup rolls. In this type of rolling mill, the larger work roll, i.e., the work roll having a larger diameter, is driven by a motor or the like to roll a sheet. A rolling mill provided with work rolls having different diameters, sometimes called a differential rolling mill (as compared with ordinary rolling mills provided with work rolls of the same diameter) is able to roll a sheet at a high draft by a low rolling force, which is advantageous in manufacturing steel sheets by rolling. Since only a small rolling force is necessary, edge drop resulting from the flattening of the rolls can be suppressed and hence steel sheets having a small thickness deviation can be manufactured.

Generally, as shown in FIG. 8, working rolls 11' and 12' included in most rolling mills are shifted downstream by an offset e with respect to backup rolls 13' and 14'. The work rolls are thus shifted downstream with respect to the backup rolls because a rolling mill in which work rolls are shifted downstream with respect to backup rolls is able to stabilize loading conditions for loading a rolled sheet more effectively than a rolling mill in which work rolls are shifted upstream with respect to backup rolls.

A related art is disclosed in JP-B No. 47421/1976.

Recently, hot rolling techniques for hot-rolling sheets are required to be capable of rolling sheets in a greater rolling width, i.e., the width of the rolled sheet, and in smaller thickness, and of rolling sheets at higher drafts. However, the diameter of the smaller work roll of the differential rolling mill is smaller and the mechanical strength of the smaller work roll is insufficient to meet the foregoing requirements. More specifically, a high stress is induced in necks, including stepped parts, at the joints of the body, which is used for rolling, of the smaller work roller and the journals, supported in bearings, of the smaller work roll.

Thus, the upper limit of the rolling width of steel sheets hot-rolled by differential rolling mills has been 4 ft (about 1200 mm). Even the differential rolling mill that needs a relatively low rolling force requires a high rolling force exceeding 3000 tons (3000 tf=$2.94\times10^7$ N) when the rolling width exceeds 4 ft. An excessively high stress unbearable by the mechanical strength of the smaller work roll is thus induced in the necks of the smaller work roll.

The present invention is intended to meet the foregoing requirements required of rolling mills for hot-rolling sheets, including capability of rolling sheets in an increased width exceeding 4 ft by reducing mechanical load on work rolls.

SUMMARY OF THE INVENTION

A sheet rolling method according to a first aspect of the present invention includes: disposing a pair of work rolls respectively having different diameters between upper and lower backup rolls; and driving only the large-diameter work roll having the greater diameter for rolling to produce a sheet; wherein the small-diameter work roll having the smaller diameter is disposed so that a rotational axis of the small-diameter work roll is positioned on a mill center or a downstream side with respect to the mill center in a rolling direction, and the large-diameter work roll is disposed so that a rotational axis of the large-diameter work roll is positioned on a downstream side with respect to the rotational axis of the small-diameter work roll in the rolling direction.

Since the sheet rolling method does not shift both the two working rolls on the upstream side of the mill center plane including the center axes of the backup rolls with respect to the rolling direction, loading conditions for rolling the sheet is stabilized, and the sheet can be smoothly and continuously rolled.

This sheet rolling method is characterized in reducing mechanical load on the work rolls even when a high rolling force is necessary for rolling a wide sheet.

The ability of the sheet rolling method to reduce the mechanical load on the work rolls can be reasoned as follows.

When a rolling mill provided with two work rolls respectively having different diameters operates for rolling to produce a sheet, the following forces a) to c) are exerted on the journals, supported in bearings, of the smaller work roll having a smaller diameter:

a) A horizontal force acting downstream with respect to the rolling direction resulting from driving only the large-diameter work roll having the greater diameter and exerted on the small-diameter work roll by a sheet being rolled (Force $SR_1$ in FIG. 3);

b) A roll bender force acting on the work roll in a plane (vertical plane) perpendicular to the rolling direction (Force $P_B$, not shown); and c) A horizontal force equal to the difference between the horizontal components of vertical forces exerted on the small-diameter work roll by the backup roll and the large-diameter work roll ($SB_1$ and $SD_1$ shown in FIG. 2) (Force $P_{mt}$ shown in FIG. 2).

These forces are exerted on the journals supported in the bearings to induce stresses in the necks of the small-diameter work roll.

Although all those forces are produced necessarily during the rolling operation, the magnitude (and the direction, in some cases) of the horizontal force ($P_{mt}$) produced by the forces ($SB_1$ and $SD_1$) is dependent on the dispositions of the large and the small-diameter work rolls relative to the backup rolls, represented by offsets.

According to an exemplary embodiment of the invention, the small-diameter and the large-diameter work rolls are disposed such that the offset of the axis of the large-diameter work roll with respect to the mill center plane is greater than the offset which could be zero in some cases of the small-diameter work roll with respect to the mill center plane. This arrangement provides for the horizontal component ($SB_1$) of the vertical force exerted by the large-diameter work roll on the small-diameter work roll and used to determine the horizontal force ($P_{mt}$, the force c)) to be directed upstream with respect to the rolling direction. Consequently, the horizontal force ($P_{mt}$, the force c)) is reduced. Since the direction of the horizontal component ($SB_1$) is opposite to the rolling direction, the horizontal force that acts on the small-diameter work roll, i.e., the resultant force acting on the small-diameter work roll, i.e., the sum of the horizontal force ($SR_1$, the force a)) and the horizontal component ($SB_1$), is reduced. When the horizontal force is reduced, the mechanical load on the small-diameter work roll is reduced accordingly even if the vertical force, such as the force b), does not change. Consequently, a sheet having a big width and a small thickness can be produced and draft at which the sheet can be rolled by one rolling mill can be increased.

In the sheet rolling method according to the first aspect of the present invention, it is preferable that an offset $e_1$ by which the rotational axis of the small-diameter work roll is shifted from the mill center plane, and an offset $e_2$ by which the rotational axis of the large-diameter work roll is shifted from the rotational axis of the small-diameter work roll (refer to FIG. 1 for $e_1$ and $e_2$) meet inequalities:

$$0\ \text{mm} \leqq e_1 \text{ and } 0\ \text{mm} < e_2 < 7\ \text{mm}$$

when the small-diameter work roll has necks of a diameter of about 270 mm or below, and a rolling force of 3000 tons (3000 tf=$2.94\times10^7$ N, 1 ton=1 tf=9800 N) or above is used for rolling work.

The diameter of the body of the small-diameter work roll having the necks of a diameter of 270 mm or below is limited by the relation of the small-diameter work roll with support means including bearings and is considerably small, such as about 400 mm or below. Since the small-diameter work roll has such a small diameter, the sheet can be rolled at a high draft by using a low rolling force. Consequently, edge drop in the sheet can be suppressed and advantages specific to differential rolling mills can be fully utilized.

As mentioned above, it is generally advantageous that both the small-diameter and the large-diameter work roll are shifted downstream of the rolling direction with respect to the mill center plane and that the offset of the large-diameter work roll is greater than the offset of the small-diameter work roll, namely, $$0 \leqq e_1 \text{ and } 0 < e_2,$$

when a high rolling force is used.

However, since the smaller the diameter of the small-diameter work roll, the more effective are the advantages specific to differential rolling mills, and the higher the rolling force, the greater the possibility of increasing rolling width. Accordingly, the offsets $e_1$ and $e_2$ must satisfy inequalities:

$$0 \leqq e_1 \text{ and } 0\ \text{mm} < e_2 < 7\ \text{mm}$$

under rolling conditions, where the diameter of the necks of the small-diameter work roll is 270 mm or below and the rolling force is about 3000 tons or above (a proper roll bender force is also added) because the horizontal force of c) increases and a stress excessively high to the small-diameter work roll of a general material is induced in the necks of the small-diameter work roll when the diameter of the necks of the small-diameter work roll and the rolling force meet the foregoing conditions, if $e_2 \leqq 0$. An undesirable warping of the sheet called bowing, i.e., the upward warping of the leading edge of the sheet passed between the small-diameter and the large-diameter work roll, occurs if 7 mm$\leqq e_2$. A sheet of a width (rolling width) on the order of 5 ft can be produced by hot-rolling a steel sheet when the rolling force is about 3000 tons or above.

A rolling mill according to a second aspect of the present invention includes: upper and lower backup rolls; and a pair of work rolls respectively having different diameters and disposed between the upper and the lower backup roll; wherein only the large-diameter work roll having the greater diameter is connected to a driving source, and wherein the small-diameter work roll having the smaller diameter is disposed so that a rotational axis of the small-diameter work roll is positioned on a mill center or a downstream side with respect to the mill center in a rolling direction, and the large-diameter work roll is disposed so that a rotational axis of the large-diameter is positioned on a downstream side with respect to the rotational axis of the small-diameter work roll in the rolling direction.

In the rolling mill according to the second aspect of the present invention, it is preferable that the small-diameter work roll has necks of a diameter of 270 mm or below, and an offset $e_1$ by which the axis of the small-diameter work roll is shifted from the mill center plane, and an offset $e_2$ by which the axis of the large-diameter work roll is shifted from the axis of the small-diameter work roll meet inequalities:

$$0\ \text{mm} \leqq e_1 \text{ and } 0\ \text{mm} < e_2 < 7\ \text{mm}.$$

Since the rolling mill is provided with the small-diameter work roll having the necks of a diameter of about 270 mm or below and a body of a considerably small diameter on the order of, for example, 400 mm, the rolling mill has characteristics specific to differential rolling mills and is capable of rolling a sheet at a high draft. Thus, the rolling mill is capable of producing steel sheets having uniform thickness effectively by rolling.

The rolling mill, in which the respective offsets $e_1$ and $e_2$ of the small-diameter and the large-diameter work roll satisfy the equalities:

$$0 \leqq e_1 \text{ and } 0 < e_2 < 7\ \text{mm},$$

has excellent abilities a) to hot-roll a steel sheet having a width (rolling width) on the order of 5 ft by using a rolling force of 3000 tons or above, b) to limit stress induced in the necks of the small-diameter work roll below a level that is not dangerous to the small-diameter work roll formed of a general material even if such a high rolling force is used, and c) to prevent undesirable bowing of the sheet passed between the work rolls.

Preferably, in the sheet rolling mill according to the second aspect of the present invention, the small-diameter work roll has a core formed of a material having a tensile strength of 45 kgf/mm$^2$ or above ($4.41\times10^8$ Pa), such as a nickel grain roll (cast high-alloy steel grain roll), a high-chromium alloy roll (high-chromium cast steel), high-speed steel roll (high-speed tool steel) or a forged high-speed steel roll.

When the small-diameter work roll is a nickel grain roll, a high-chromium alloy roll, a high-speed steel roll or a forged high-speed steel roll formed of a material having a tensile strength of 45 kgf/mm$^2$ or above, the rolling method according to the first aspect of the present invention can be advantageously carried out without being subject to restrictions, because a rolling force of abut 3000 tons or above can be exerted on the small-diameter work roll having the necks of a diameter of about 270 mm or above, and the small-diameter work roll formed of a material having a tensile strength of 45 kgf/mm$^2$ or above, which is higher than a maximum stress of about 40 kgf/mm$^2$ ($3.92\times10^8$ Pa) that is expected to be induced in the small-diameter work roll when a roll bender force, which is comparatively low because the small-diameter work roll has a small diameter, does not have any problem in mechanical strength. Generally, high-speed steel rolls or forged high-speed steel rolls have a tensile strength of 80 kgf/mm$^2$ ($7.84\times10^8$ Pa) or above and hence problems attributable to fatigue resulting from rotation involving repeated stress cycles can be easily avoided.

DETAILED DESCRIPTION OF PREFERRED EMBODIMENTS

Figure 1:
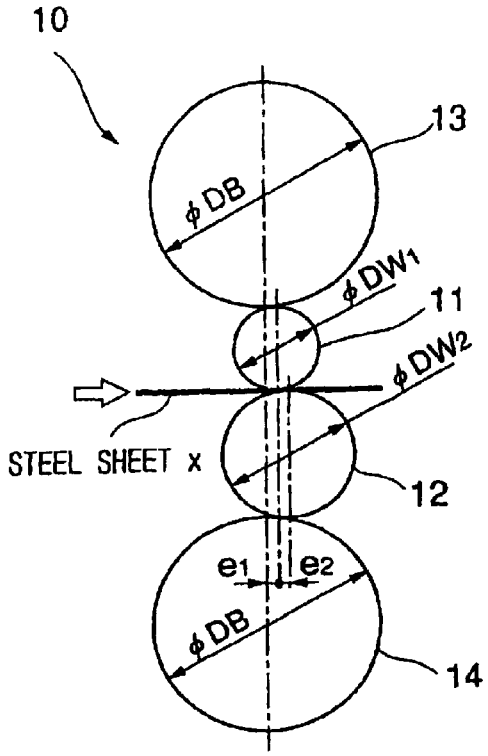
FIG. 1 is a typical view of one of the rolling mills 10 shown in FIG. 7 in a preferred embodiment according to the present invention.

FIGS. 1 to 7 show a preferred embodiment of the present invention. FIG. 1 is a typical side elevation of one of three downstream mills 10 in a back stage (downstream side) of a rolling line 1 shown in FIG. 7.

Figure 7:
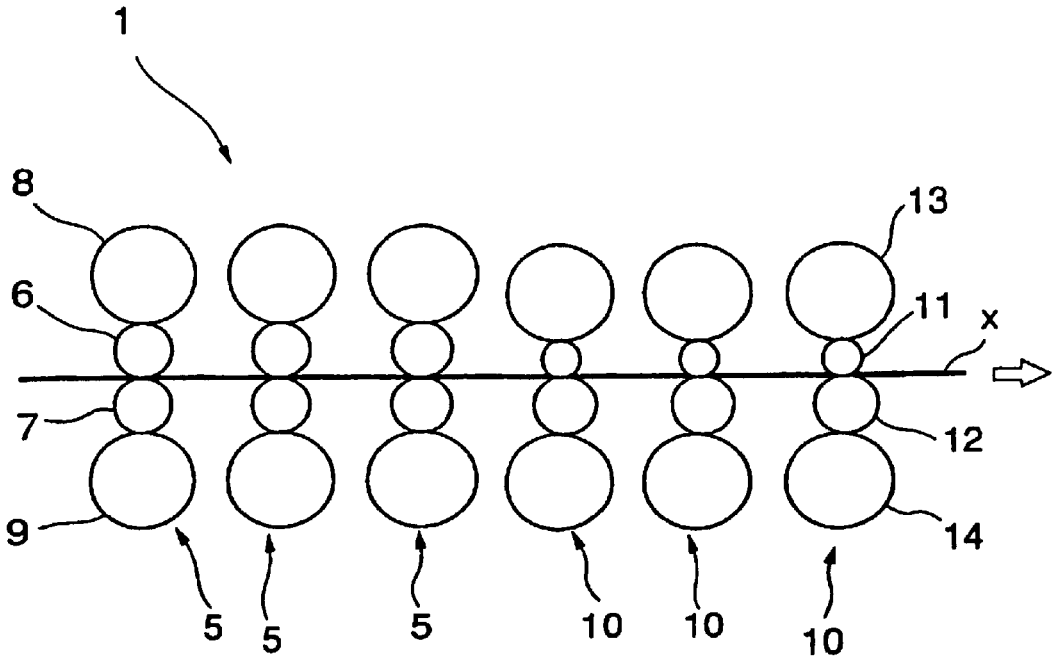
FIG. 7 is a typical view of a sheet rolling mill for hot-rolling sheets.
Figure 8:
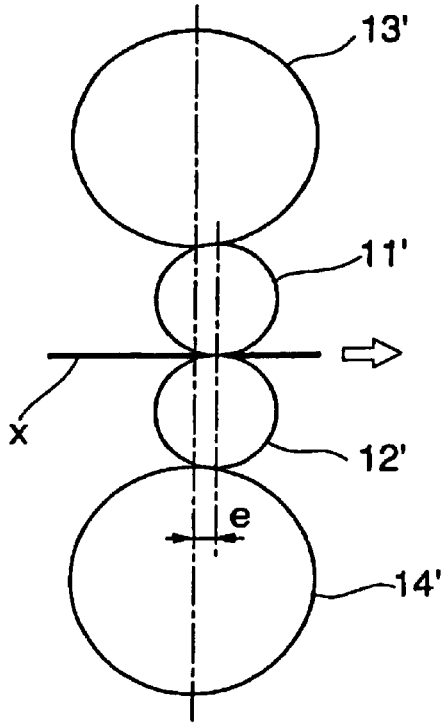
FIG.8 (Related Art)
FIG. 8 is a typical view of a conventional rolling mill.

The rolling line 1 for hot-rolling a steel sheet x is a tandem rolling line having six rolling mills 5 and 10 as shown in FIG. 7. The three front rolling mills 5 in a front stage (upstream side) are ordinary four-high mills each having two work rolls 6 and 7 of the same diameter disposed one on top of the other, and upper and lower backup rolls 8 and 9 supporting the work rolls 6 and 7. The three back rolling mills 10 in the back stage are so-called differential rolling mills each having an upper backup roll 13, a lower backup roll 14 and a pair of work rolls 11 and 12 respectively having different diameters and disposed between the backup rolls 13 and 14. Both the two work rolls 6 and 7 of each of the three front rolling mills 5 are driven for rotation, while only the lower work roll 12 of each of the three back rolling mills 10 in the back stage is driven for rotation because the required torque of the back rolling mills 10 is not high.

Referring to FIG. 1 showing the back rolling mill 10, the diameter $DW_1$ of the small-diameter work roll 11 is 450 mm, the diameter $DW_2$ of the large-diameter work-roll 12 is 590 mm, the diameters DB of the backup rolls 13 and 14 are 1300 mm, Unless otherwise specified, the diameter of a roll is that of a part of the roll that comes into contact with the steel sheet x and the body of the adjacent roll. In the back rolling stand 10, an offset $e_1$ of the rotational axis of the small-diameter work roll 11 from the mill center plane, i.e., the plane including the center axes of the backup rolls 13 and 14, and an offset $e_2$ of the rotational axis of the large-diameter work roll 12 from the rotational axis of the small-diameter roll 11 are variable. In this embodiment, $$e_1=6 \text{ mm and } e_2=4 \text{ mm.}$$

The rolling line 1 hot-rolls a hot-rolled soft steel plate (SPHC, JIS) of 25 mm in thickness into a steel sheet of 1.2 mm in thickness and 1550 mm in width. The rolling line 1 operates on a pass schedule setting the thicknesses of the sheet at the respective exits of the front rolling mills 5 and the back rolling mills 10 to, for example, 10.97 mm, 5.12 mm, 3.46 mm, 2.22 mm, 1.49 mm and 1.17 mm, respectively. A roll bender force of 80 ton ($P_{B1}$ and $P_{B2}$) is exerted on each of chocks supporting the work rolls 11 and 12 of the rolling mills 5 and 10 to control the shape of the steel sheet x.

Generally, the rolling mills 5 and 10 need to exert considerably high rolling forces on the steel sheet when the rolling width is big. Mechanical measures must be incorporated into the back rolling mills 10 provided with the small-diameter work roll 11 in which an excessively high stress is liable to be induced when a high rolling force is used. Elaborate measures to withstand stress must be taken particularly for the fourth rolling mill 10 that uses a high rolling force higher than those used by the rest of the back rolling mills 10, i.e., the uppermost one among the three back rolling mills 10 in the back stage. In the rolling line 1 shown in FIG. 7, the fourth rolling mill 10 uses a rolling force as high as 3000 tons. The offsets $e_1$ and $e_2$ in the fourth rolling mill 10, i.e., a differential rolling mill, are determined so that an excessively high stress may not be induced in the small-diameter work roll 11 even a high rolling force is exerted to the small-diameter work roll 11.

In a rolling mill in a comparative example, $$e_1=6 \text{ mm and } e_2=0 \text{ mm.}$$

The rolling mill 10 and the rolling mill in the comparative example will be compared, and the results of mechanical examination of the work rolls 11 and 12 will be explained hereinafter.

Figure 3:
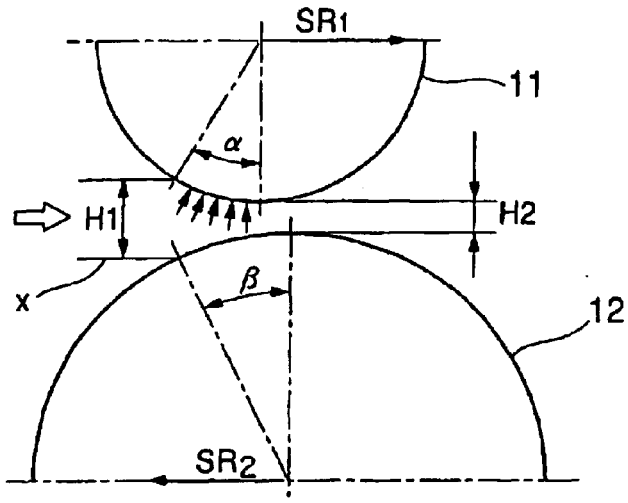
FIG. 3 is a typical view of assistance in explaining horizontal forces produced when only a large-diameter work roll 12 is driven for rotation.

Stresses that may be induced in the small-diameter work roll 11 and the large-diameter work roll 12 are calculated in the following manner. Forces exerted on the work rolls 11 and 12 include:

a) horizontal forces $SR_1$ and $SR_2$ acting on the work rolls 11 and 13 in directions shown in FIG. 3, respectively, by the steel sheet x when only the large-diameter work roll 12 is driven for rotation, b) roll bender forces $P_{B1}$ and $P_{B2}$ (80 tons, not indicated) acting on the work rolls 11 and 12 in a vertical plane perpendicular to the rolling direction, and c) horizontal forces $P_{mT}$ and $P_{mB}$ acting on the work rolls 11 and 12, respectively, when a rolling force (3000 tons for the fourth rolling mill 10) is exerted on the work rolls 11 and 12 through the backup rolls 13 and 14 in contact with the work rolls 11 and 12, respectively.

Figure 2:
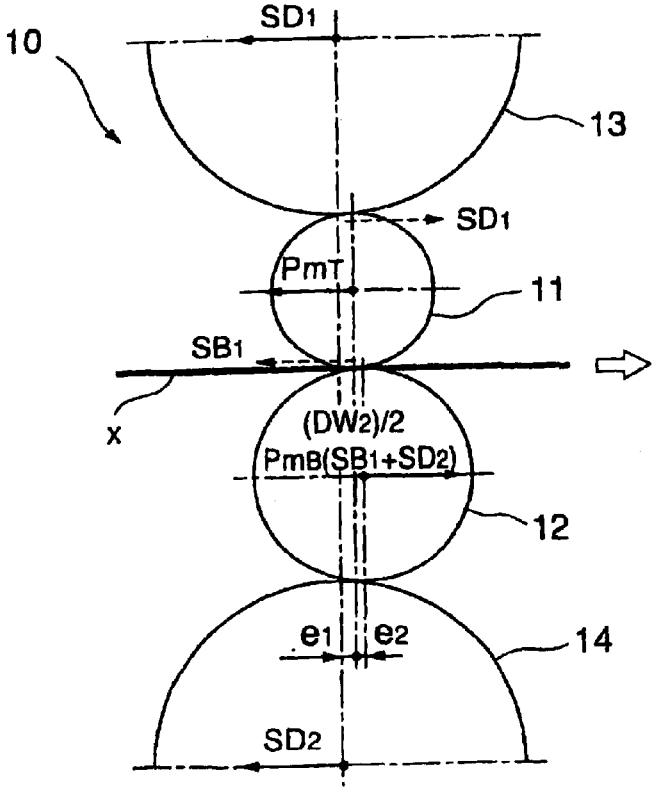
FIG. 2 is a typical view of assistance in explaining horizontal forces exerted on rolls by vertical rolling force.
Figure 6:
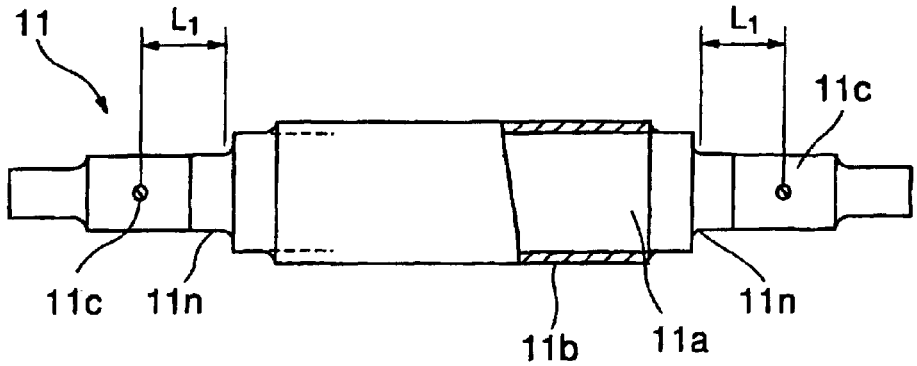
FIG. 6 is a front elevation of the small-diameter work roll.

Vertical forces acting on the work rolls 11 and 12 do not need to be considered because forces exerted on the working rolls 11 and 12 by the backup rolls 13 and 14 are balanced by forces exerted on the work rolls 11 and 12 by the steel sheet x. Referring to FIG. 6 showing the small-diameter work roll 11, the forces a) to c) exerted on a body 11*b* included in the small-diameter work roll 11 are counterbalanced by reaction forces exerted by bearings, not shown, on journals 11*c*. The magnitudes of the forces a) to c) will be examined supposing that forces acting in the rolling direction, i.e., the direction of the blank arrows in FIGS. 2 and 3, are positive forces.

$$SR_1=P_R\cdot\tan(\alpha/s) \quad (1)$$

$$SR_2=SR_1 \quad (2)$$

where $P_R$ is rolling force, and $\alpha$ is center angle corresponding to a part, in contact with the steel sheet x, of the circumference of the small-diameter work roll 11 expressed by:

$$\alpha=\cos^{-1}[\{DW_1-2DW_2\Delta H/(DW_1+DW_2)\}/DW_1]$$

where $\Delta H$ is the difference (1.24 mm) between the thickness H1 (3.46 mm) of the steel sheet x at the entrance of the fourth rolling mill 10, and the thickness H2 (2.22 mm) of the steel sheet x at the exit of the fourth rolling mill 10. In both the rolling mill 10 in the embodiment and the rolling mill in the comparative example, $\alpha$=4.53° from $\Delta$H=1.24 mm, and hence, using Expressions (1) and (2), $SR_1$=118.7 tons, and $SR_2$=118.7 tons.

The forces c) shown in FIG. 2 are:

$$P_{mT}=SB_{=1}-SD_1 \quad (3)$$

$$P_{mB}=SD_2+SB_1 \quad (4)$$

where $$SB_1=P_R\cdot\tan[\sin^{-1}\{2e_2/(DW_1+DW_2)\}]$$

$$SD_1=P_R\cdot\tan[\sin^{-1}\{2e_1/(DB+DW_1)\}]$$

$$SD_2=P_R\cdot\tan[\sin^{-1}\{2(e_1+e_2)/(DB+DW_2)\}]$$

Since $e_1$=6 mm and $e_2$=4 mm in the rolling mill 10 in the embodiment, horizontal forces $P_{mT}$ and $P_{mB}$ are calculated by using Expressions (3) and (4).

$$P_{mT}=SB_1-SD_1=23.1-20.6=2.5 \text{ (tons)}$$

$$P_{mB}=SD_2+SB_1=31.7+23.1=54.8 \text{ (tons)}$$

Since $e_1$=6 mm and $e_2$=0 mm in the rolling mill in the comparative example, $$P_{mT}=SB_1-SD_1=0-20.6=-20.6 \text{ (tons)}$$

$$P_{mB}=SD_2+SB_1=10.0+0=19.0 \text{ (tons)}$$

Total forces (the sum of the forces a) to c)) $F_1$ and $F_2$ that act, respectively, on the work rolls 11 and 12 are:

$$F_1=\{(SR_1-P_{mT})^2+PB_1^2\}^{1/2}$$

$$F_2=\{(-SR_2+PmB)^2+PB_2^2\}^{1/2}$$

Thus, reaction forces corresponding to the forces $F_1$ and $F_2$ act on the journals 11*c* of the small-diameter work roll 11, and those of the large-diameter work roll 12. The values of the total forces $F_1$ and $F_2$ are converted into those in kgf (1 kgf=9.8 N) as follows.

$F_1$ and $F_2$ for the embodiment are:

$F_1$=141,100 (kgf) and $F_2$=102,400 (kgf).

$F_1$ and $F_2$ for the comparative example are:

$F_1$=160,600 (kgf) and $F_2$=127,800 (kgf).

Whereas the forces $SR_1$ and $P_{B1}$ of the total force $F_1$ acting on the small-diameter work roll 11 are always positive, the force $P_{mT}=SB_1-SD_1$ is negative and the total force $F_1$ can be reduced when $$2e_2/(DW_1+DW_2)>2e_1/(DB+DW_1).$$

The rolling mill in the comparative example, in which $e_1$=6 mm and $e_2$=0 mm, is unable to satisfy this inequality, and hence the total force $F_1$ is high.

Since forces respectively corresponding to the total forces $F_1$ and $F_2$ are exerted on the necks 11*n* (FIG. 6) of the small-diameter work roll 11 and those of the large-diameter work roll 12, bending moments $M_1$ and $M_2$ proportional to the lengths $L_1$ and $L_2$ between the necks and the centers of the corresponding journals are produced at the necks 11*n* of the small-diameter work roll 11 and those of the large-diameter work roll 12. Consequently, bending stresses $\pi_1$ and $\pi_2$ are induced in the necks of the work rolls 11 and 12 according to the respective section moduli $Z_1$ and $Z_2$ of the work rolls 11 and 12 and a stress concentration factor $\alpha$ at the neck. Generally, $M=F\times L$, $Z=\pi D^3/32$ and $\sigma=\sigma\times M/Z$, where D is diameter. $L_1$=265 mm and D (diameter of the neck)=270 mm in the small-diameter work roll 11, $L_1$=265 mm and D (diameter of the neck)=270 mm in the large-diameter work roll 12, and $\alpha$ is about 1.8. Therefore, in the rolling mill 10 in the embodiment, in which $e_1$=6 mm and $e_2$=4 mm, $\sigma_1$=34.8 kgf/mm$^2$, and $\sigma_2$=15.9 kgf/mm$^2$, and in the rolling mill in the comparative example, in which $e_1$=6 mm and $e_2$=0 mm, $\sigma_1$=39.7 kgf/mm$^2$, and $\sigma_2$=19.9 kgf/mm$^2$ (1 kgf/mm$^2$=9.8×10$^6$ Pa).

Figure 4:
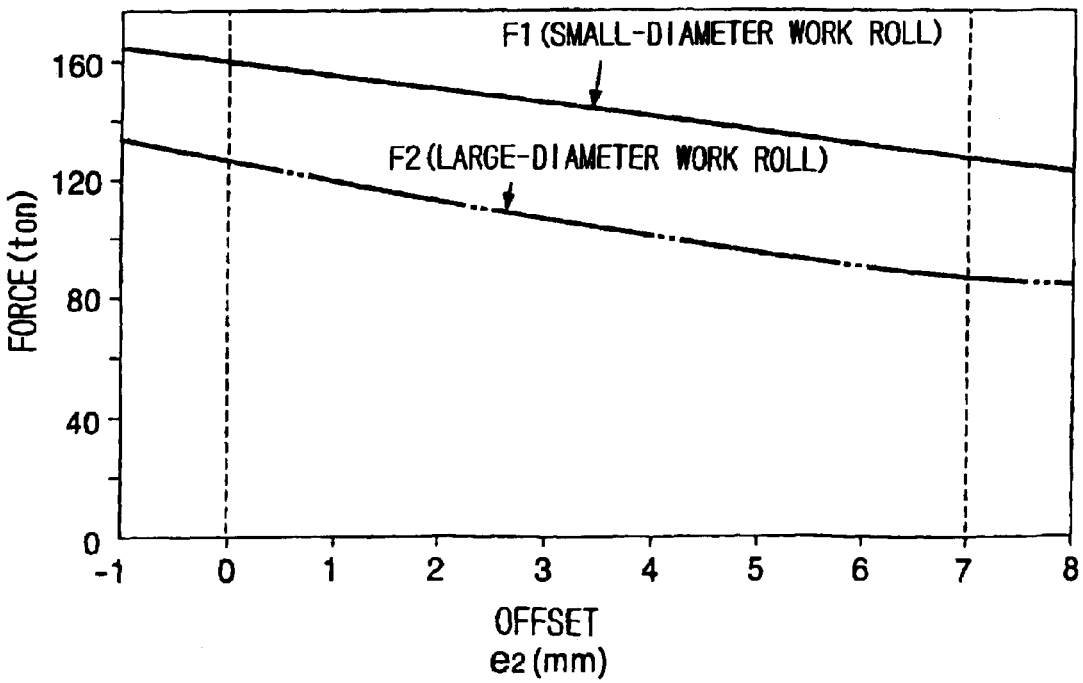
FIG. 4 is a graph showing the dependence of resultant forces $F_1$ and $F_2$ exerted, respectively, on the work rolls 11 and 12 on the offset $e_2$ of the rotational axis of the large-diameter work roll 12 from the rotational axis of the small-diameter work roll 11.
Figure 5:
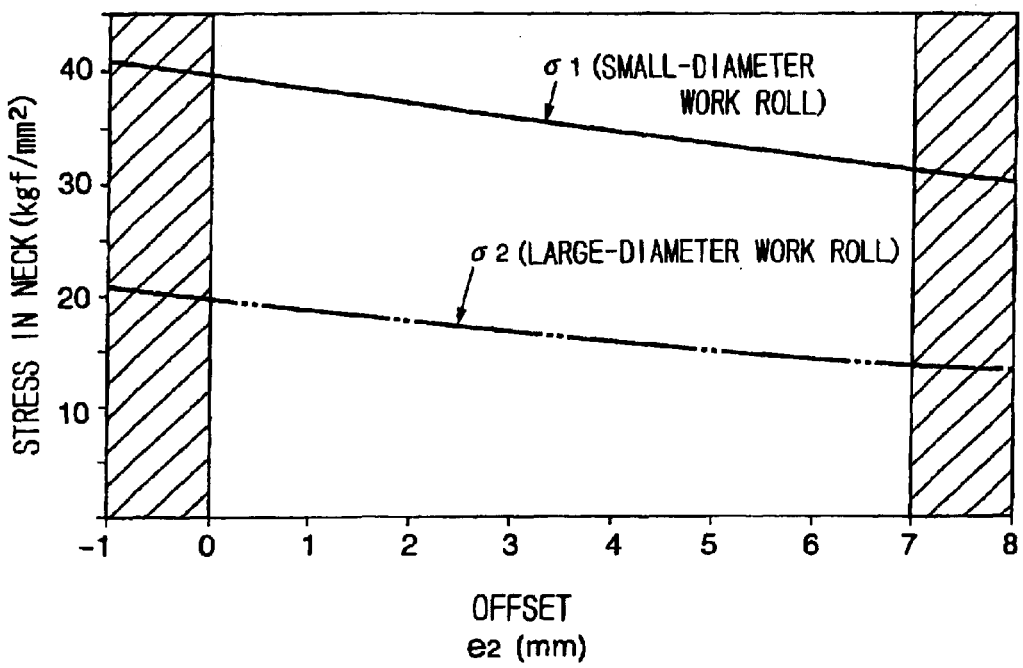
FIG. 5 is a graph showing the dependence of stresses $\sigma_1$ and $\sigma_2$ induced, respectively, in the necks of the work rolls 11 and 12 on the offset $e_2$ of the rotational axis of the large-diameter work roll.

FIGS. 4 and 5 are graphs showing the variation with the offset $e_2$ of the total forces $F_1$ and $F_2$ acting on the work rolls 11 and 12 and bending stresses $\sigma_1$ and $\sigma_2$ induced in the necks of the work rolls 11 and 12 when $e_1$ is 6 mm. The total force $F_1$ and the bending stress $\sigma_1$ decreases as the offset $e_2$ increases in both the work rolls 11 and 12.

As obvious from FIG. 5, the stress $\sigma_1$ induced in the small-diameter work roll 11 exceeds 40 kgf/mm$^2$ when $e_2$<0 mm. Since the core 11*a* of an ordinary material, such as a nickel grain roll (a part of the body 11*b* of the work roll 11 excluding a surface skin as shown in FIG. 6) has problem in withstanding the stress $\sigma_1$ exceeding 40 kgf/mm$^2$, it is preferable that $e_2$>0.

If $e_2$>7 mm, bowing of the steel sheet x, i.e., upward warping of the leading edge of the steel sheet x passed between the small-diameter work roll 11 and the large-diameter work roll 12 occurs and smooth rolling is impossible.

Therefore, the offset $e_2$ must meet an inequality:

$$0<e_2<7 \text{ mm},$$

namely, a value in a not shaded region in FIG. 5, when $e_1$=6 mm under the foregoing rolling conditions including the rolling force, the diameter of the work roll, the pass schedule, the roll bender force and such.

The present invention is applicable to rolling of sheets using a rolling mill provided with a pair of work rolls respectively having different diameters.

What is claimed is:

1. A sheet hot rolling method comprising:

disposing a pair of work rolls respectively having different diameters between upper and lower backup rolls; and driving only a large-diameter work roll of the pair of work rolls for hot rolling to produce a sheet;

wherein a small-diameter work roll of the pair of work rolls is disposed so that a rotational axis of the small-diameter work roll is positioned on a mill center, the mill center corresponding to a plane including center axes of the upper and lower backup rolls, or a downstream side with respect to the mill center in a rolling direction, and the large-diameter work roll is disposed so that a rotational axis of the large-diameter work roll is positioned on a downstream side with respect to the rotational axis of the small-diameter work roll in the rolling direction.

2. The sheet rolling method according to claim 1, wherein an offset $e_1$ by which the rotational axis of the small-diameter work roll is shifted in the rolling direction from the mill center, and an offset $e_2$ by which the rotational axis of the large-diameter work roll is shifted in the rolling direction from the rotational axis of the small-diameter work roll meet inequalities:

$$0 \text{ mm}\leqq e_1 \text{ and } 0 \text{ mm}<e_2<7 \text{ mm}$$

when the small-diameter work roll has a neck of a diameter of about 270 mm or below, and a rolling force of 3000 tons or above is used for rolling.

3. A hot rolling mill for producing a sheet comprising:

upper and lower backup rolls; and a pair of work rolls respectively having different diameters and disposed between the upper and the lower backup rolls;

wherein only a large-diameter work roll of the pair of work rolls is connected to a driving source, and wherein a small-diameter work roll of the pair of work rolls is disposed so that a rotational axis of the small-diameter work roll is positioned on a mill center, the mill center corresponding to a plane including center axes of the upper and lower backup rolls, or a downstream side with respect to the mill center in a rolling direction, and the large-diameter work roll is disposed so that a rotational axis of the large-diameter is positioned on a downstream side with respect to the rotational axis of the small-diameter work roll in the rolling direction.

4. The rolling mill according to claim 3, wherein the small-diameter work roll has a neck of a diameter of 270 mm or below, and an offset $e_1$ by which the rotational axis of the small-diameter work roll is shifted from the mill center, and an offset $e_2$ by which the rotational axis of the large-diameter work roll is shifted from the rotational axis of the small-diameter work roll meet inequalities: $0\ \text{mm} \leqq e_1$ and $0\ \text{mm} < e_2 < 7\ \text{mm}$.

5. The rolling mill according to claim 4, wherein a nickel grain roll, a high-chromium alloy roll, a high-speed steel roll or a forged high-speed steel roll having a tensile strength of 45 $\text{kgf/mm}^2$ or above is used as a core material of the small-diameter work roll.

* * * * *